US007987955B2

(12) United States Patent
Puchalski

(10) Patent No.: US 7,987,955 B2
(45) Date of Patent: Aug. 2, 2011

(54) RETRACTING LUGGAGE WORK STATION

(76) Inventor: Jeffery L. Puchalski, Laguna Niguel, CA (US)

( * ) Notice: Subject to any disclaimer, the term of this patent is extended or adjusted under 35 U.S.C. 154(b) by 368 days.

(21) Appl. No.: 12/379,046

(22) Filed: Feb. 11, 2009

(65) Prior Publication Data

US 2009/0255771 A1 Oct. 15, 2009

Related U.S. Application Data

(60) Provisional application No. 61/071,159, filed on Apr. 15, 2008.

(51) Int. Cl.
*A45C 5/14* (2006.01)

(52) U.S. Cl. ..... 190/18 A; 190/9; 190/10; 190/11; 190/115

(58) Field of Classification Search ..... 190/18 A, 190/1, 9, 10, 11, 115
See application file for complete search history.

(56) References Cited

U.S. PATENT DOCUMENTS

| | | | | |
|---|---|---|---|---|
| 3,557,916 | A | 1/1971 | Stowell | |
| 4,966,258 | A | 10/1990 | Hawley | |
| 5,374,073 | A | 12/1994 | Hung-Hsin | |
| 5,507,508 | A | 4/1996 | Liang | 280/37 |
| 5,941,352 | A | 8/1999 | Lee | |
| 6,213,265 | B1 | 4/2001 | Wang | |
| 6,237,734 | B1 | 5/2001 | Chen | |
| 6,471,019 | B1 | 10/2002 | Miller | |
| 6,543,796 | B1 | 4/2003 | Johnson et al. | |
| 6,644,447 | B2 | 11/2003 | Pohl | 190/8 |
| 6,932,427 | B2 | 8/2005 | Tamura | 297/217.1 |
| 7,097,017 | B1 | 8/2006 | LaCrosse et al. | |
| 7,309,106 | B2 | 12/2007 | Stallman | 297/310 |
| 7,350,857 | B2 | 4/2008 | Bishop | 297/129 |
| 7,901,018 | B2 | 3/2011 | Baughman | 312/240 |
| 2004/0066069 | A1 | 4/2004 | Caldana | |
| 2005/0098402 | A1 | 5/2005 | Cohen | |
| 2005/0150733 | A1 | 7/2005 | Chen | |
| 2005/0194226 | A1 | 9/2005 | Wang et al. | |
| 2006/0261654 | A1 | 11/2006 | Stallman | 297/310 |
| 2007/0089952 | A1 | 4/2007 | Herbst et al. | |
| 2008/0217129 | A1 | 9/2008 | Whelan | 190/8 |

FOREIGN PATENT DOCUMENTS

| | | |
|---|---|---|
| JP | 2001088705 | 4/2001 |

*Primary Examiner* — Tri M Mai
(74) *Attorney, Agent, or Firm* — Richard C. Litman

(57) ABSTRACT

The retracting luggage work station is a rolling suitcase with a retractable shelf that extends out from the top of the suitcase and provides support for a portable laptop computer or food or beverage items while waiting at an airport or other transportation terminal. The shelf also can function as a seat. Vertical telescoping support members are attached to the front of the shelf, and the back of the shelf engages a slot on the interior of the extendable handles of the suitcase permitting the shelf to be height adjustable. An integral carrying strap is attached to the top of the suitcase for aid in stowing the luggage work station in an overhead compartment or under an airplane seat.

5 Claims, 4 Drawing Sheets

RETRACTING LUGGAGE WORK STATION

CROSS-REFERENCE TO RELATED APPLICATION

This application claims the benefit of U.S. Provisional Patent Application Ser. No. 61/071,159, filed Apr. 15, 2008.

BACKGROUND OF THE INVENTION

1. Field of the Invention

The present invention relates to shipping containers and, more particularly to a retracting luggage work station that provides a rolling suitcase with a work station that extends out from the suitcase to support a laptop computer, food items or the like while waiting at an airport or other transportation terminal.

2. Description of the Related Art

Suitcases and luggage with wheels and retractable handles are well known. These features enable the user to easily extend the handle upwardly and pivot the suitcase onto its wheels in order to provide the user with an easy and convenient method of transporting the suitcase. Many people find rolling luggage far more preferable than using a shoulder strap or a handle for transporting the suitcase.

Typically, airplane travelers carry portable computers and other personal electronic items in a separate carrying case, in addition to the conventional suitcase in which common travel items are stored. This is done so that the larger suitcase can be checked with the airline and the computer can be brought onboard the airplane and used during the flight to catch up on work while away from the office. Additionally, as most major airports offer WiFi and other wireless Internet access, airplane travelers also utilize their laptop computers while waiting at airport terminals.

In addition to working on a laptop computer, it is also convenient for travelers to have a table or other flat surface to enjoy a meal or beverage. Often, because airport gates and food service areas are very crowded, there are no available tables or suitable flat surfaces upon which to place a laptop or a meal. Thus, a retracting luggage work station solving the aforementioned problems is desired.

SUMMARY OF THE INVENTION

The retracting luggage work station is a rolling suitcase with an extendable handle that has a retractable work frame extendable outwardly from a side of the suitcase. The work frame has a floor support that extends outwardly from the bottom of the suitcase for stability. A shelf slides out of the top of the suitcase and is suitable for holding a laptop computer or food and beverage items while waiting at an airport or other transportation terminal. The shelf may also function as a seat.

Two telescoping support members support the front of the shelf, and the back of the shelf engages a pair of slots on the inner surface of the extendable handle portion, permitting the shelf to be height adjustable.

The work frame retracts completely into the suitcase and the handle extends upwardly, allowing the suitcase to be tipped onto its wheels for easy transport through airports, train and bus terminals. An integral handle strap on the top of the suitcase aids in stowing the luggage work station in an overhead storage compartment or underneath a seat.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
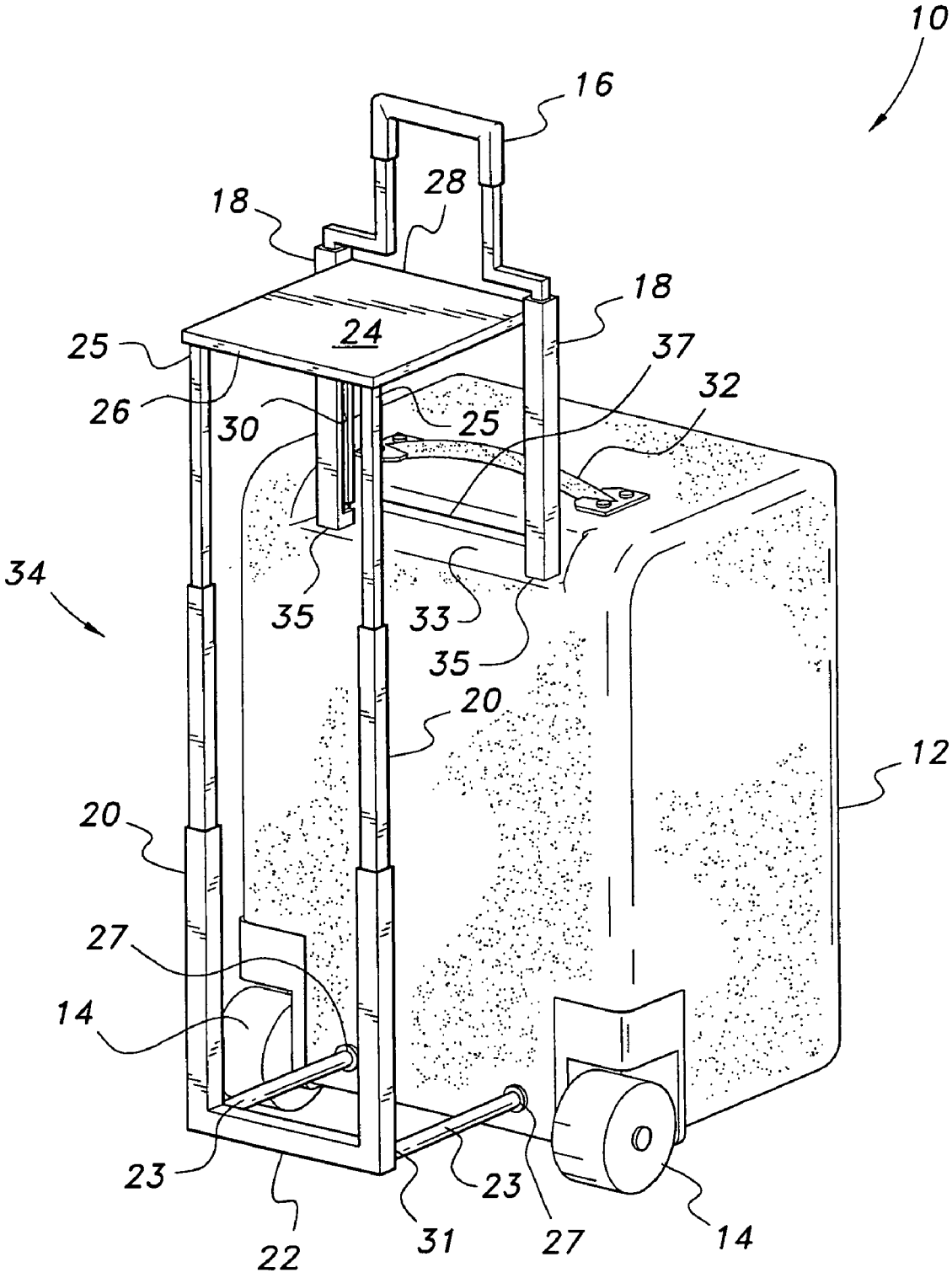
FIG. 1 is a perspective view of a retracting luggage work station according to the present invention configured as a work station with the shelf in a raised position.

The present invention relates to a retracting luggage work station suitable for holding a laptop computer, food or beverage items, or functioning as a seat while waiting at an airport or other transportation terminal. The retracting luggage work station is shown in FIG. 1 in perspective view and designated generally as 10 in the drawings. A substantially cube-shaped suitcase 12 rolls on a pair of wheels 14. A handle portion 16 is connected to a pair of telescoping tubes 18 that extend upwardly from the top of the suitcase 12 for easy transport while traversing train stations, airport concourses, and the like.

The luggage work station 10 has a retractable work frame 34 that extends out from a side of the suitcase 12. The work frame 34 has a shelf 24 that slides out from the top of the suitcase 12, a pair of horizontal supports or outriggers 23 that retract into and extend from the base of the suitcase 12 adjacent wheels 14, and telescoping support members 20 extending upward from the outriggers 23. Outriggers 23 extend outwardly from a pair of channels 27 formed in suitcase 12 adjacent wheels 14. Shelf 24 is mounted to upper ends 25 of the telescoping support members 20. The shelf 24 may be adapted to hold a laptop computer, food or beverages, and may also function as a seat.

The height of the shelf 24 may be adjusted for comfort or convenience. The pair of telescoping support members 20 support the front side 26 of the shelf 24. The back side 28 of the shelf 24 engages with a slot 30 (e.g., by a roller and track assembly) on the inner surface of the telescoping handle tubes 18. A floor support 22 extending across the ends 31 of the outriggers 23 and supporting telescoping members 20 provides stability for the work frame 34 when using the shelf 24 as a laptop table or a table for eating or reading. FIG. 1 illustrates the shelf 24 in the highest position.

Figure 2:
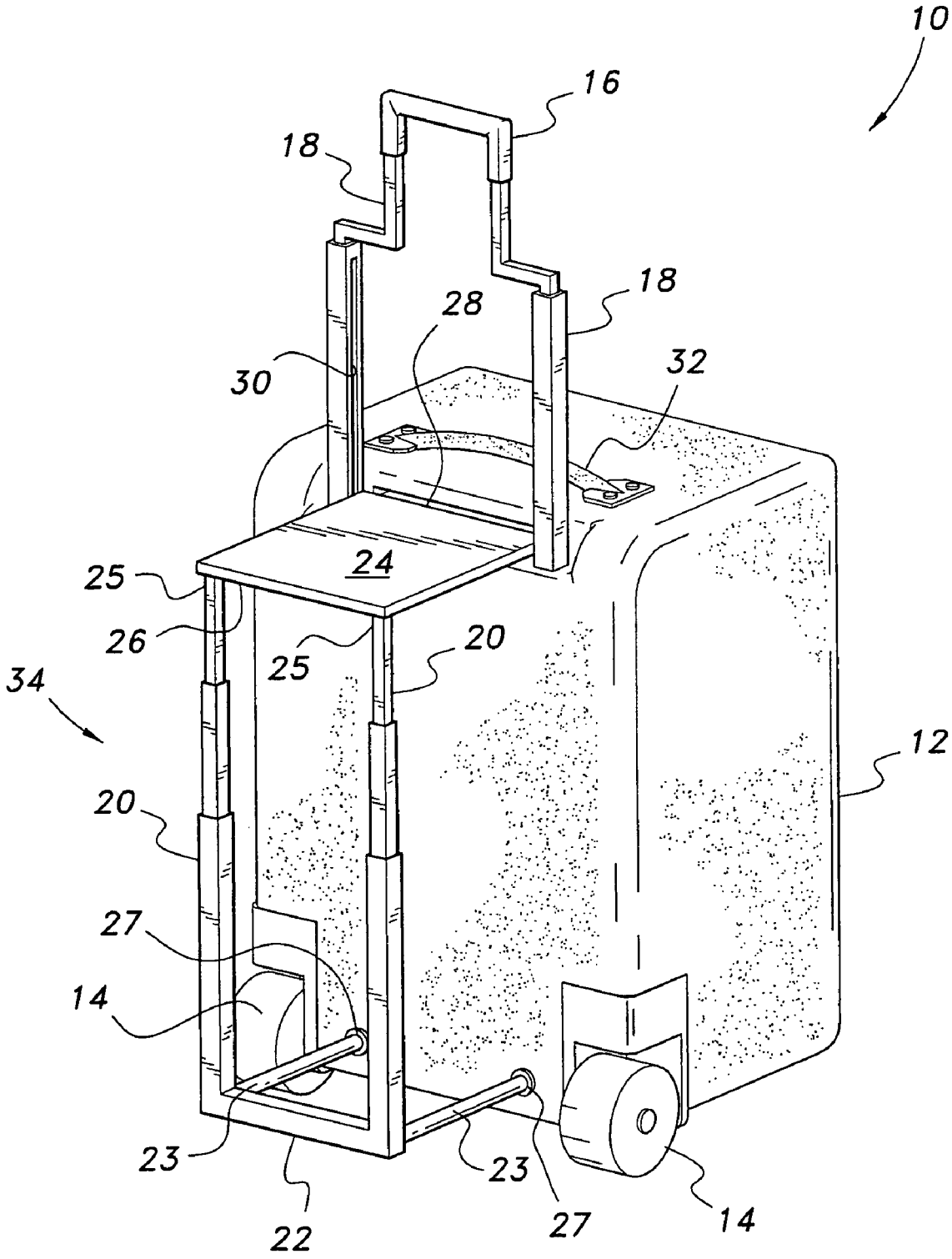
FIG. 2 is a perspective view of a retracting luggage work station according to the present invention with the shelf in a lowered position.

FIG. 2 shows the shelf 24 in the lowest position, coplanar with the top surface of the suitcase 12. The telescoping members 20 are collapsed to lower the shelf 24, and the back end 28 of shelf 24 is slid downward within slots 30. As best shown in FIG. 1, the upper end of suitcase 12 has a recess 33 formed therein. The back end 28 of shelf 24 supported in recess 33 when the shelf 24 is lowered to its lowest position, as shown in FIG. 2. A horizontal slot 37 is formed in the upper end of the suitcase 12 at the rear of recess 33. In FIG. 2, the work frame 34 remains fully extended from the suitcase 12. This position may be most useful when working on a laptop computer while seated.

Figure 3:
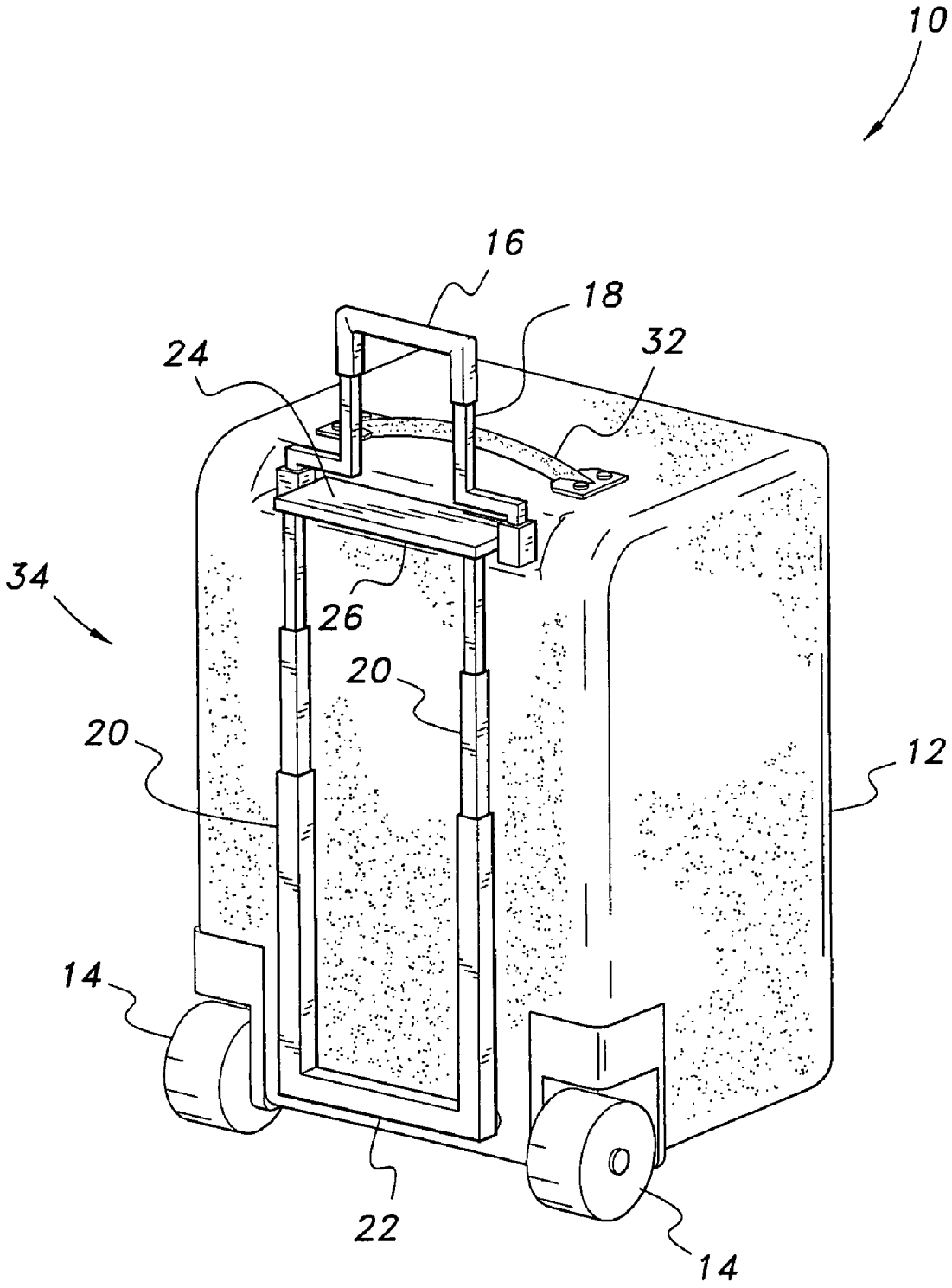
FIG. 3 is a perspective view of a retracting luggage work station according to the present invention with the work frame and handle retracted.

FIG. 3 shows the luggage work station 10 with the work frame 34 retracted into a side of the suitcase 12. The handle portion 16 is in the lowest position to allow the luggage work station 10 to be taken aboard an airplane. Tubes 18 are retracted into channels 35. An integral strap handle 32 is mounted on the top surface of the suitcase 12 as an aid to stowing the luggage work station 10 under a seat or in an overhead compartment.

Figure 4:
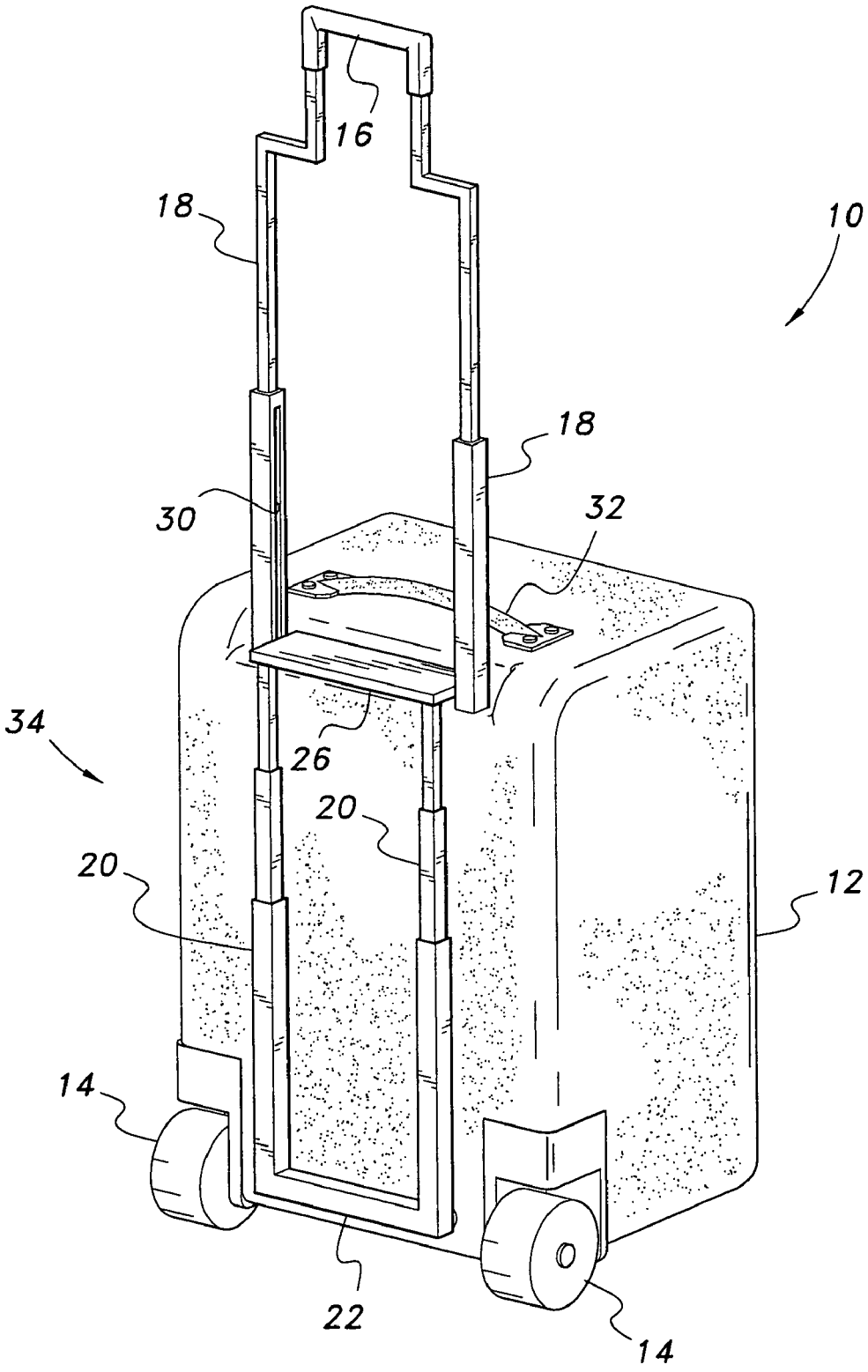
FIG. 4 is a perspective view of a retracting luggage work station according to the present invention with the handle extended for transport.

FIG. 4 shows the luggage work station 10 with the handle portion 16 and the telescoping tubes 18 fully extended. The work frame 34 is fully retracted. This configuration may be most useful for pulling the luggage work station 10 through an airport or train station as a conventional rolling bag. Additionally, with the telescoping tubes 18 fully extended, an additional piece of luggage or other item may be placed on top of the luggage work station 10 for convenient transport.

It is to be understood that the present invention is not limited to the embodiment described above, but encompasses any and all embodiments within the scope of the following claims.

I claim:

1. A retracting luggage work station, comprising:

a suitcase having a top having a slot defined therein, a base, and a plurality of wheels rotatably mounted on the base of the suitcase;

a handle having telescoping tubes retractable into and extendable from the top of the suitcase, each of the tubes having an axially extendable slot defined therein;

a work frame having outriggers retractable into and extendable from the base of the suitcase and telescoping support tubes mounted on the outriggers; and a shelf having a first end attached to the telescoping support tubes and an opposite second end retractable through the slot in the top of the suitcase and having means for engaging the axially extending slots defined in the telescoping handle tubes.

2. The retracting luggage work station as recited in claim 1, wherein said shelf is extendable between a raised position above the top of said suitcase when said handle is extended and a lowered position substantially coplanar with the top of said suitcase when said handle is lowered.

3. The retracting luggage work station as recited in claim 2, wherein the top of said suitcase has a recess formed therein, the second end of said shelf resting upon and being supported by the recess when said shelf is in the lowered position.

4. The retracting luggage work station as recited in claim 1, further comprising a strap handle fixed to the top of said suitcase.

5. The retracting luggage work station as recited in claim 1, further comprising a floor support extending between said outriggers.

* * * * *